US009549445B2

(12) United States Patent
Vos et al.

(10) Patent No.: US 9,549,445 B2
(45) Date of Patent: Jan. 17, 2017

(54) SECTIONED NETWORK LIGHTING DEVICE USING FULL DISTRIBUTION OF LED BINS

(71) Applicant: 3M Innovative Properties Company, St. Paul, MN (US)

(72) Inventors: Martin J. Vos, Miinneapolis, MN (US); Michael J. Meis, Stillwater, MN (US); James F. Poch, St. Paul, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 512 days.

(21) Appl. No.: 14/068,765

(22) Filed: Oct. 31, 2013

(65) Prior Publication Data

US 2015/0115800 A1 Apr. 30, 2015

(51) Int. Cl.
*H05B 37/02* (2006.01)
*H05B 33/08* (2006.01)

(52) U.S. Cl.
CPC ..... *H05B 33/0857* (2013.01)

(58) Field of Classification Search
CPC ..... H05B 37/02; H05B 33/08; H05B 33/0833; H05B 33/0842; H05B 33/0845; H05B 33/0857
USPC ..... 315/185 R, 186, 209 R, 210, 291, 294,315/307, 308, 312
See application file for complete search history.

(56) References Cited

U.S. PATENT DOCUMENTS

| | | | | |
|---|---|---|---|---|
| 8,410,717 | B2 | 4/2013 | Shteynberg | |
| 8,410,720 | B2 | 4/2013 | Holec | |
| 8,456,095 | B2 | 6/2013 | Huynh | |
| 2008/0001547 | A1* | 1/2008 | Negru | H02J 7/0065 315/189 |
| 2010/0096993 | A1* | 4/2010 | Ashdown | F21V 29/004 315/113 |
| 2010/0134018 | A1* | 6/2010 | Tziony | H05B 33/083 315/122 |
| 2012/0050697 | A1 | 3/2012 | Suzuki | |
| 2012/0098448 | A1 | 4/2012 | Kang | |
| 2012/0206047 | A1 | 8/2012 | Vos | |
| 2012/0306392 | A1 | 12/2012 | Young | |
| 2013/0077299 | A1 | 3/2013 | Hussell | |
| 2014/0015441 | A1* | 1/2014 | Radermacher | H05B 33/0809 315/294 |

FOREIGN PATENT DOCUMENTS

| | | |
|---|---|---|
| JP | 2009-230973 | 10/2009 |
| JP | 2010-056314 | 3/2010 |
| WO | WO 2010-027254 | 3/2010 |
| WO | WO 2011-053708 | 5/2011 |
| WO | WO 2013-090252 | 6/2013 |

* cited by examiner

*Primary Examiner* — Jimmy Vu

(57) ABSTRACT

A driver circuit is configured for connection to a power source and includes a plurality of light emitting diodes (LEDs) having at least one performance characteristic that varies according to different performance categories ranging between higher performance and lower performance. The driver circuit also includes a plurality of LED sections each populated with at least one LED of a different one of the different performance categories. Circuitry is coupled to the LED sections and configured to activate and deactivate the LED sections based on LED performance.

24 Claims, 14 Drawing Sheets

SECTIONED NETWORK LIGHTING DEVICE USING FULL DISTRIBUTION OF LED BINS

BACKGROUND

Manufactures of light emitting diodes (LEDs) have long had the problem of fabricating high efficiency LEDs. High efficiency LEDs can be made in laboratory settings, but cannot be reliably obtained on 100% of production. As a consequence, LEDs are categorized into "bins" of varying efficiency. LEDs can also be categorized into bins for color temperature and color rendering index (CRI). Companies that manufacture LED light producing devices (e.g., LED light bulbs) are required to pay a premium for high efficiency LEDs, which need to be culled from the full distribution of LEDs produced by the LED manufacturer. Cost savings on the order of 50% or more could be realized if the full distribution of LEDs could be used instead of the culled high efficiency LEDs. Use of a manufacturer's full distribution of LEDs, however, poses challenges due to significant variations in efficiency (optical power/electrical power in lm/W), color or color temperature, and/or color rendering index among un-culled LEDs.

BRIEF SUMMARY

Embodiments are directed to a driver circuit configured for connection to a power source. The driver circuit includes a plurality of light emitting diodes (LEDs) having at least one performance characteristic that varies according to different performance categories ranging between higher performance and lower performance. The driver circuit also includes a plurality of LED sections each populated with at least one LED of a different one of the different performance categories. Circuitry is coupled to the LED sections and configured to activate and deactivate the LED sections based on LED performance.

Some embodiments are directed to a driver circuit configured for connection to a power source and including a plurality of light emitting diodes having efficiencies that vary according to different efficiency categories ranging between higher efficiency and lower efficiency. Each of a plurality of LED sections is populated with at least one LED of a different one of the different efficiency categories. Circuitry is coupled to the LED sections and configured to activate and deactivate the LED sections based on LED efficiency.

Other embodiments are directed to a driver circuit configured for connection to a power source and including a plurality of light emitting diodes having efficiencies that vary according to different efficiency categories ranging between higher efficiency and lower efficiency. The driver circuit also includes a plurality of LED sections each populated with at least one LED of a different one of the different efficiency categories. Circuitry is coupled to the LED sections and configured to power the LED sections at different duty cycles based on LED efficiency.

Further embodiments are directed to a method involving supplying power to a driver circuit comprising a plurality of light emitting diodes that vary in terms of at least one performance characteristic falling into one of a plurality of different performance categories, the driver circuit further comprising a plurality of electrically coupled LED sections each comprising one or more LEDs of only one of the different performance categories. The method also involves sequentially activating the LED sections according to a sequence progressing from LED sections with higher performance LEDs to those with lower performance LEDs. The method further involves sequentially deactivating the LED sections according to a sequence progressing from LED sections with lower performance LEDs to those with higher performance LEDs.

Still other embodiments are directed to a method involving providing a plurality of light emitting diodes (LEDs) that vary in terms of at least one performance characteristic falling into one of a plurality of different performance categories. The method also involves forming a plurality of electrically coupled LED sections of a light producing device, each of the LED sections configured to controllably power one or more of the LEDs. The method further involves incorporating the one or more LEDs associated with the different performance categories into respective LED sections of the light producing device, such that each LED section comprises one or more LEDs of only one of the different performance categories.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

The disclosure may be more completely understood in connection with the accompanying drawings, in which.

DETAILED DESCRIPTION

Embodiments of the disclosure are directed to a light producing device that incorporates driver circuitry for selectively activating and deactivating LEDs having varying performance characteristics. According to various embodiments, a light producing device incorporates a multiplicity of LEDs that vary in terms of at least one performance characteristic. Based on the performance characteristic of interest, such as efficiency or color temperature for example, the LEDs are binned (e.g., categorized or ranked) according to different performance categories. Light producing device embodiments of the disclosure include a multiplicity of LED sections, each of which includes one or more LEDs associated with one of the different performance categories. In some embodiments, one or more of the LED sections can include LED(s) from a mix of different performance categories, and each LED section can have a specified ratio of high to low bin performance LEDs. Circuitry is coupled to the LED sections and configured to power the LED sections based on LED performance or performance category. For example, the circuitry can be configured to power the LED sections at different duty cycles based on LED performance category. A light producing device according to embodiments of the disclosure incorporates LEDs across a manufacturer's full distribution of LED bins, resulting in a significant cost savings and good lighting performance (e.g., a minimal reduction in performance with respect to top bin LEDs or an improvement with respect to average bin LEDs). Various embodiments are directed to a light producing device that incorporates LEDs across a manufacturer's full distribution of LED bins and dimmer circuitry.

Figure 1:
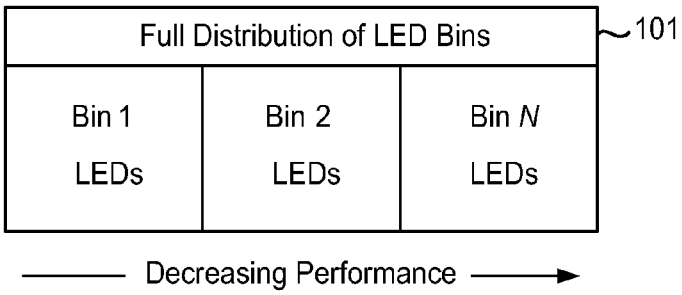
FIG. 1 illustrates a representative distribution of LEDs segregated into different bins based on one or more performance characteristics of the LEDs.

FIG. 1 illustrates a representative distribution of LEDs segregated into different bins based on one or more performance characteristics of the LEDs produced by a manufacturer. In FIG. 1, the LEDs are categorized or "binned" based on one or more performance characteristics, with each LED being assigned to one of Bins 1-N. As is indicated in FIG. 1, the LEDs of Bin 1 have been determined by the manufacturer to be the best performing LEDs of the full LED distribution. The LEDs of Bin 2 have been determined by the manufacturer to be the next best performing LEDs of the full LED distribution. The performance of the binned LEDs decreases with increasing bin number, with Bin N having the poorest performing LEDs. As was previously discussed, LED manufacturers charge a premium for their best performing LEDs (e.g., Bin 1 LEDs). However, appreciable cost savings (e.g., up to 50% or more) can be realized if the full distribution of LED bins 101 were purchased instead of the highest performing bin of LEDs.

Figure 2:
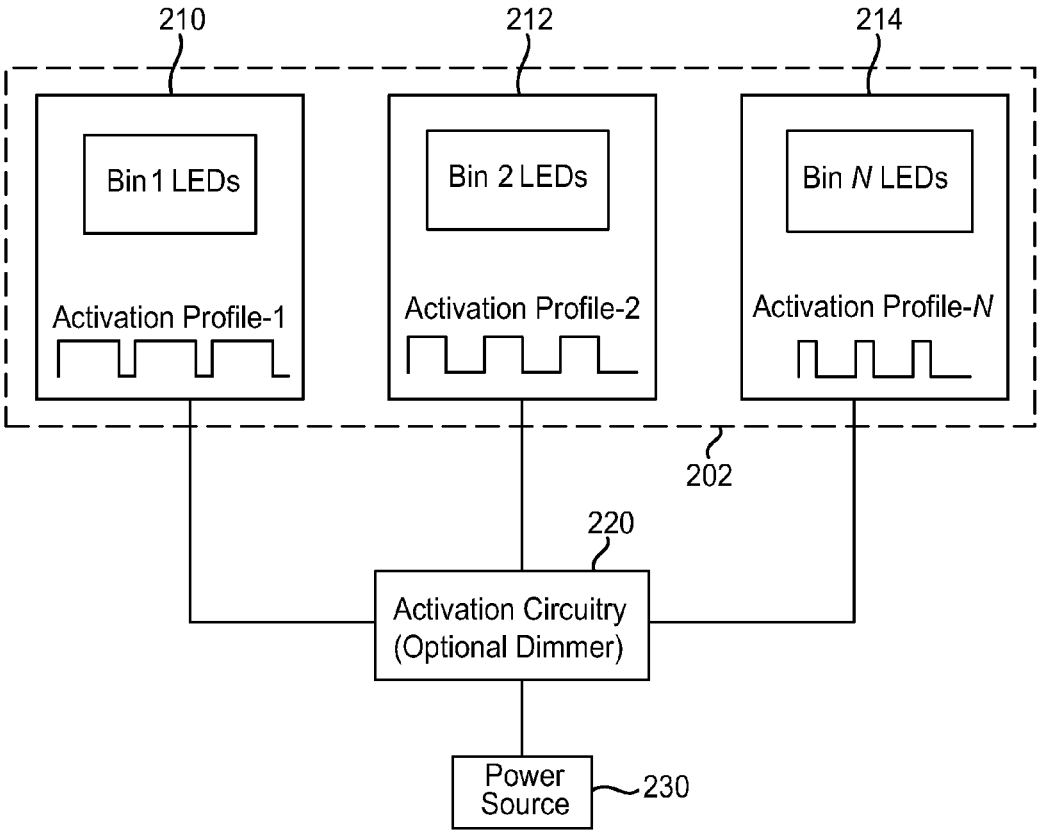
FIG. 2 is a block diagram of a light producing device that incorporates LEDs having varying performance characteristics and a driver circuit for selectively activating the LEDs based on performance characteristics in accordance with various embodiments.

FIG. 2 illustrates a block diagram of a light producing device that incorporates LEDs having varying performance characteristics and a driver circuit for selectively activating the LEDs based on performance characteristics in accordance with various embodiments. The light producing device shown in FIG. 2 includes a light fixture 202 and activation circuitry 220. The activation circuitry 220 includes a driver circuit configured for connection to a power source 230. In some embodiments, the activation circuitry 220 includes a dimmer, such as a phase cut dimmer or a harmonic current dimmer. The light fixture 202 includes a multiplicity of LED sections 210, 212, and 214. Although three LED sections 210, 212, 214 are shown in FIG. 2, it is understood that the light fixture 202 can include any number of LED sections (e.g., any number of sections between 2 and 20 or more).

Each of the LED sections 210, 212, 214 includes at least one LED, with each section typically including several electrically connected LEDs (e.g., between 2-12 LEDs per section). Any number of LEDs can be used in each LED section. The number of LEDs used per section is a function of application voltage (e.g., US 120V, EU 230V) and the number of segments chosen. A general rule would be to divide the application voltage by the number of sections, then divide the result by 3 to determine the number of LEDs per section. This general rule, however, can be deviated from for other performance, efficiency, and size considerations.

According to various embodiments, each LED section 210, 212, 214 is populated with LEDs of a different performance category. For example, and with reference to FIG. 2, LED section 210 is populated with the highest performing LEDs (Bin 1 LEDs) of the full distribution of LED bins provided by a manufacturer. LED section 212 is populated with the next highest performing LEDs (Bin 2 LEDs) of the full distribution of LED bins provided by the manufacturer. LED section 214 is populated with the lowest performing LEDs (Bin N LEDs) of the full distribution of LED bins provided by the manufacturer. It can be appreciated that the light fixture 202 illustrated in FIG. 2 incorporates LEDs across the full distribution of LED bins provided by a manufacturer, thereby resulting in a significant reduction in cost of manufacturing the light fixture 202.

Activation circuitry 220 is electrically coupled to the LED sections 210, 212, and 214. The activation circuitry 220 is configured to power each LED section 210, 212, 214 differently than other LED sections. For example, the activation circuitry 220 is configured to power the LED sections 210, 212, 214 based on the performance characteristics of the LEDs populating each of the sections 210, 212, 214. According to various embodiments, the activation circuitry 220 implements and activation protocol that is unique to each of the LED sections 210, 212, 214. The activation protocols implemented by the activation circuitry 220 can differ in terms of duty cycle, for example, as is depicted by the different activation profiles 1-N illustrated for the LED sections 210, 212, 214 in FIG. 2. In general terms, the activation circuitry 220 is configured to supply power for a longer duration to LED sections with higher performing LEDs than for LED sections with lower performing LEDs. According to various embodiments, the activation circuitry 220 is configured to activate an LED section with higher performance LEDs (e.g., LED section 210) before one with lower performance LEDs (e.g., LED section 214). The activation circuitry 220 is further configured to deactivate an LED section with higher performance LEDs (e.g., LED section 212) after one with lower performance LEDs (e.g., LED section 214).

According to some embodiments, in addition to driving LED sections 210, 212, and 214 at different duty cycles, the drive current supplied to these LED sections can differ. For example, an LED section that is operated at a shorter duty cycle (e.g., LED section 214) can be driven at a higher drive current relative to an LED section operated at a longer duty cycle (e.g., LED section 210) in order to boost the performance of LEDs drawn from lower efficiency bins. Separately, or in addition, each duty cycle can be at a different drive current according to some embodiments. For example, longer duty cycles can be at nominal to maximum driver current while the shortest drive current can be at or above maximum drive current for a shorter time. It is understood that, while LEDs have a nominal drive current rating and a maximum drive current rating, they also have a maximum pulsed current rating that can be as much as 10 times higher than the nominal or maximum drive current rating.

Figure 3:
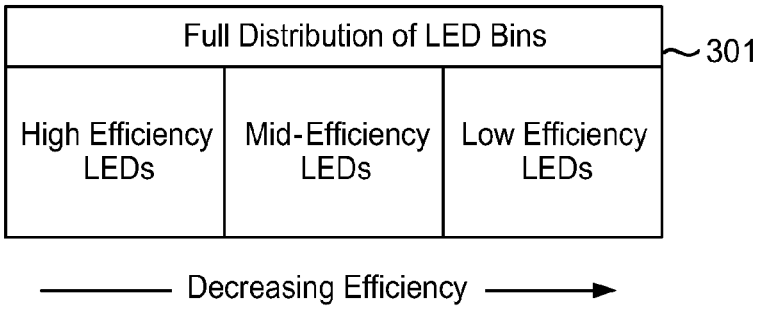
FIG. 3 illustrates a representative full distribution of LEDs produced by a manufacturer that are binned in accordance with varying levels of efficiency.

FIG. 3 illustrates a representative full distribution of LEDs produced by a manufacturer that are binned in accordance with varying levels of efficiency. In the context of various embodiments of the disclosure, the term "efficiency" refers to luminous efficiency, which may be expressed as a percentage. The term efficiency in the context of various embodiments is interchangeable with the term luminous efficacy of radiation, which is dimensionless but typically expressed in units of lumen per watt (lm/W). It is understood in the art that the luminous efficacy of a source is a measure of the efficiency with which the source provides visible light from electricity. In the illustrative example of FIG. 3, a manufacturer's full distribution of LED bins 301 includes three bins of varying efficiency. The full distribution of LED bins 301 includes a high efficiency LED bin, a mid-efficiency LED bin, and a low efficiency LED bin. It is understood that the full distribution of LED bins 301 illustrated in FIG. 3 may include fewer or more bins than the number shown in FIG. 3.

Figure 4:
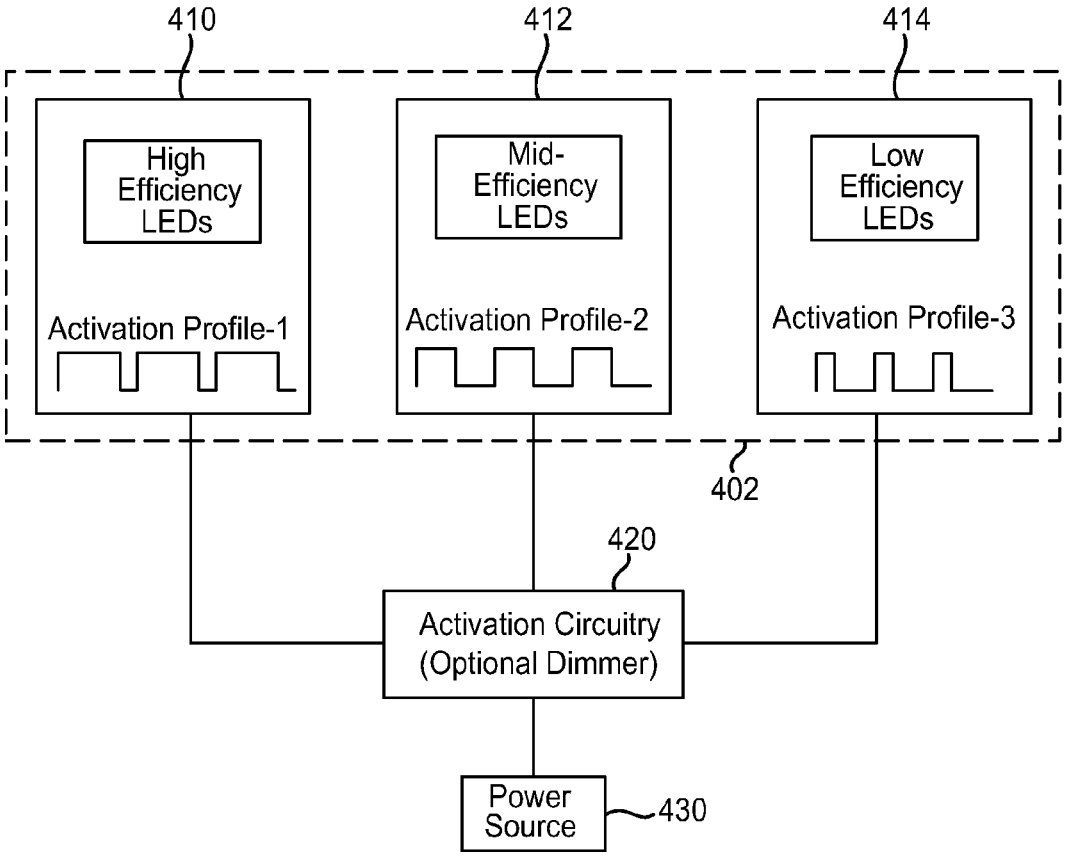
FIG. 4 is a block diagram of a light producing device that incorporates LEDs having varying efficiency and a driver circuit for selectively activating the LEDs based on efficiency in accordance with various embodiments.

The light producing device shown in FIG. 4 includes a light fixture 402 and activation circuitry 420. The activation circuitry 420 includes a driver circuit configured for connection to a power source 430. In some embodiments, the activation circuitry 420 includes a dimmer, such as a phase cut dimmer or a harmonic current dimmer. Using the full distribution of LED bins 301 illustrated in FIG. 3, a light fixture 402 can be fabricated to include three LED sections 410, 412, and 414, each of which is populated by one or more LEDs from one of the three efficiency bins 301. According to various embodiments, LED section 410 is populated with one or more of the highest efficiency LEDs obtained from the high efficiency LED bin, LED section 412 is populated with one or more of the mid-efficiency LEDs obtained from the mid-efficiency LED bin, and LED section 414 is populated with one or more of the low efficiency LEDs obtained from the low efficiency LED bin.

Activation circuitry 420 is electrically coupled to the LED sections 410, 412, and 414. The activation circuitry 420 is configured to power each LED section 410, 412, 414 in accordance with an activation protocol based on the efficiency (or efficacy) of the LEDs populating the respective LED sections. The activation protocols implemented by the activation circuitry 420 for each of the LED sections 410, 412, and 414 can differ in terms of duty cycle, for example, as is depicted by the different activation profiles 1-3 illustrated for the LED sections 410, 412, and 414 in FIG. 4. In general terms, the activation circuitry 420 is configured to supply power for a longer duration to LED sections with higher efficiency LEDs than for LED sections with lower efficiency LEDs. According to various embodiments, the activation circuitry 420 is configured to activate an LED section with higher efficiency LEDs (e.g., LED section 410) before one with lower efficiency LEDs (e.g., LED section 414). The activation circuitry 420 is further configured to deactivate an LED section with higher efficiency LEDs (e.g., LED section 412) after one with lower efficiency LEDs (e.g., LED section 414).

According to some embodiments, the drive current supplied to the LED sections 410, 412, and 414 can differ. For example, an LED section that is operated at a shorter duty cycle (e.g., LED section 414) can be driven at a higher drive current relative to an LED section operated at a longer duty cycle (e.g., LED section 412) in order to boost the performance of LEDs drawn from lower efficiency bins. Separately, or in addition, each duty cycle can be at a different drive current according to some embodiments. For example, longer duty cycles can be at nominal to maximum driver current while the shortest drive current can be at or above maximum drive current for a shorter time. As discussed previously, while LEDs have a nominal drive current rating and a maximum drive current rating, they also have a maximum pulsed current rating that can be as much as 10 times higher than the nominal or maximum drive current rating.

While lowering the cost, embodiments of the disclosure also provide the benefit of improving system efficiency. Depending upon the LEDs used, for example, an efficiency increase of 1 or 2 lm/W can be realized over the average of LED bins, in addition to significant cost savings, by using a manufacturer's full distribution of LED efficiency (or efficacy) bins. This efficiency increase, while seemingly small, can have a large impact thermally and optically on the overall system.

Figure 5:
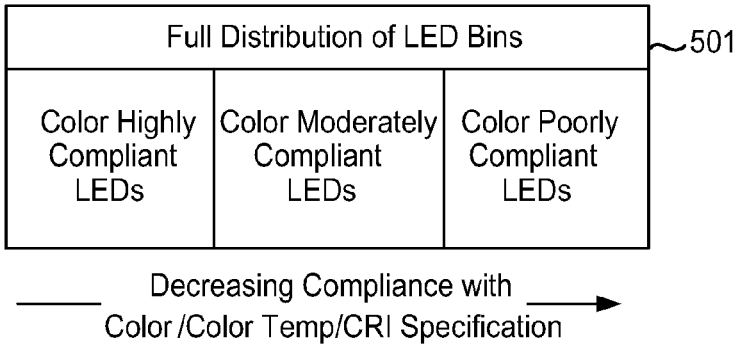
FIG. 5 illustrates a representative full distribution of LEDs produced by a manufacturer that are binned according to variations in color, color temperature or color rendering index relative to a pre-established color specification.
Figure 6:
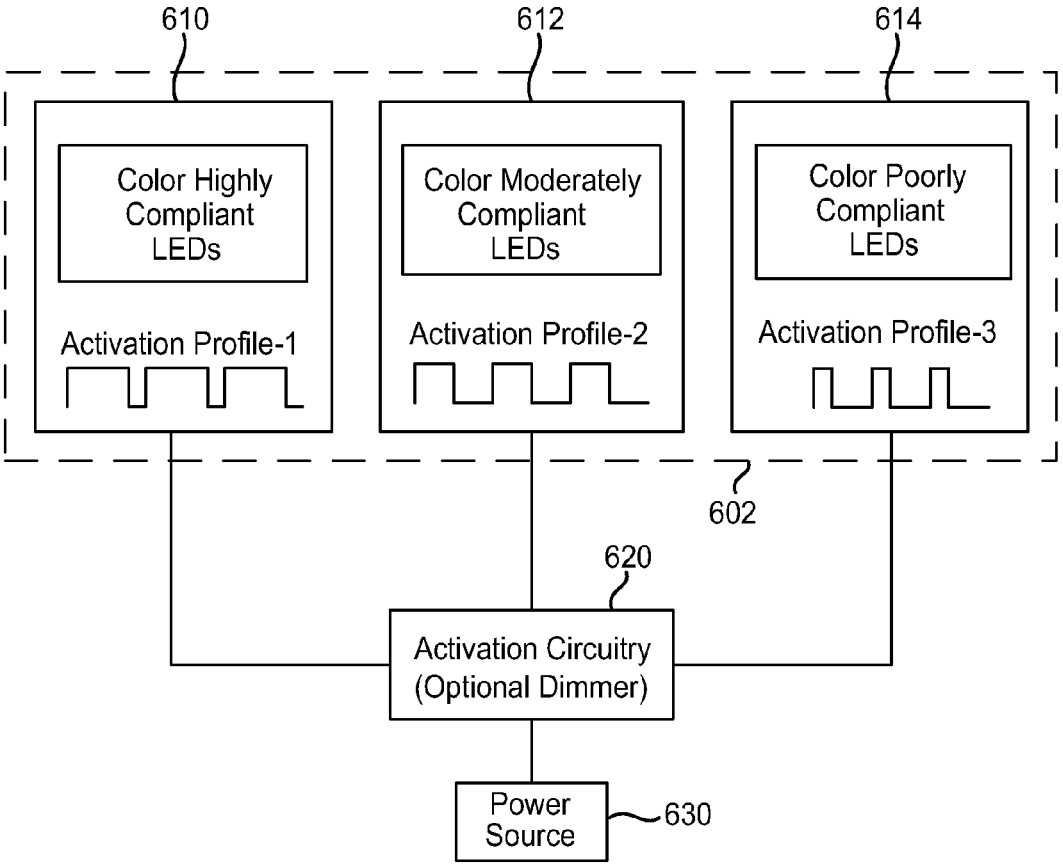
FIG. 6 illustrates a light producing device fabricated using the binned LEDs shown in FIG. 5 according to various embodiments.

FIG. 5 illustrates a representative full distribution of LEDs produced by a manufacturer that are binned according to variations in color, color temperature or color rendering index relative to a pre-established color specification. FIG. 6 illustrates a light producing device fabricated using the binned LEDs shown in FIG. 5. In the illustrative example of FIG. 5, a manufacturer's full distribution of LED bins 501 includes three bins of LEDs having different color characteristics (e.g., variations in color, color temperature or CRI). The LEDs are segregated into different bins based on compliance to a pre-established specification characterizing the LEDs in terms of color, color temperature or CRI. The full distribution of LED bins 501 includes a highly compliant LED bin, a moderately compliant LED bin, and a poorly compliant LED bin. It is understood that the full distribution of LED bins 501 illustrated in FIG. 5 may include fewer or more bins than the number shown.

Some LED manufacturers offer LED binning by color temperature based on perceived variations using a metric called a MacAdams Ellipse, which is a measure of the range of color shifts that appear to be the same to an observer. MacAdams ellipses describe the color distances on a set of XY coordinates. For LED lighting, a 3 step MacAdams Ellipse is considered high quality binning control. One can purchase LEDs binned to 3 step MacAdams ellipse at a premium cost, 5 step for less cost, and no binning control for the lowest cost. Using this illustrative scenario, a light fixture can be fabricated with two LED sections, one LED section populated with LEDs binned to 3 step that are on for the longest duration, and a second LED section populated with the lowest cost "no bin" LEDs which are powered for the shortest duration. The combination of segregating LEDs into different LED sections based on color compliance to a pre-established specification and powering the LED section with higher color compliance longer than the LED section with lower color compliance reduces cost without changing the intended color of the system in a noticeable fashion.

According to various embodiments, LEDs of a prescribed color (e.g., a specified color temperature or CRI) are used for most LED segments of a light fixture, and lower cost LEDs of any color are used for one or a few LED segments of the light fixture. The LED segment(s) populated with lower cost LEDs of any color are powered for a short time, such that the lower cost LEDs contribute photons to the overall brightness but a color shift would not normally be perceived.

The representative light producing device shown in FIG. 6 includes a light fixture 602 and activation circuitry 620. The activation circuitry 620 includes a driver circuit configured for connection to a power source 630. In some embodiments, the activation circuitry 620 includes a dimmer, such as a phase cut dimmer or a harmonic current dimmer. Using the full distribution of LED bins 501 illustrated in FIG. 5, a light fixture 602 can be fabricated to include three LED sections 610, 612, and 614, each of which is populated by one or more LEDs from one of the three color compliance bins 501.

According to various embodiments, LED section 610 is populated with one or more of the highly compliant LEDs obtained from the highly compliant LED bin, LED section 612 is populated with one or more of the moderately compliant LEDs obtained from the moderately compliant LED bin, and LED section 614 is populated with one or more of the poorly compliant LEDs obtained from the poorly compliant LED bin. It is noted that the full distribution of LED bins 501 based on color, color temperature or CRI accuracy may include a miscellaneous bin or a "no bin" category of LEDs. Such miscellaneous or no bin LEDs are often at the low end of cost and can be used to populate the poorly compliant LED section 614.

Activation circuitry 620 is electrically coupled to the LED sections 610, 612, and 614. The activation circuitry 620 is configured to power each LED section 610, 612, 614 in accordance with an activation protocol based on the color, color temperature or CRI compliance of the LEDs populating the respective sections. The activation protocols implemented by the activation circuitry 620 for each of the LED sections 610, 612, and 614 can differ in terms of duty cycle, for example, as is depicted by the different activation profiles 1-3 illustrated for the LED sections 610, 612, and 614 in FIG. 6. In general terms, the activation circuitry 620 is configured to supply power for a longer duration to LED sections with higher color compliance LEDs than for LED sections with lower color compliance LEDs. According to various embodiments, the activation circuitry 620 is configured to activate an LED section with higher color compliance LEDs (e.g., LED section 610) before one with lower color compliance LEDs (e.g., LED section 614). The activation circuitry is further configured to deactivate an LED section with higher color compliance LEDs (e.g., LED section 612) after one with lower color compliance LEDs (e.g., LED section 614).

According to some embodiments, in addition to driving LED sections 610, 612, and 614 at different duty cycles, the drive current supplied to these LED sections can differ. For example, an LED section that is operated at a shorter duty cycle (e.g., LED section 614) can be driven at a higher drive current relative to an LED section operated at a longer duty cycle (e.g., LED section 610) in order to boost the performance of LEDs drawn from bins containing lower color compliance LEDs. Separately, or in addition, each duty cycle can be at a different drive current according to some embodiments. For example, longer duty cycles can be at nominal to maximum driver current while the shortest drive current can be at or above maximum drive current for a shorter time. As discussed previously, while LEDs have a nominal drive current rating and a maximum drive current rating, they also have a maximum pulsed current rating that can be as much as 10 times higher than the nominal or maximum drive current rating.

Figure 7:
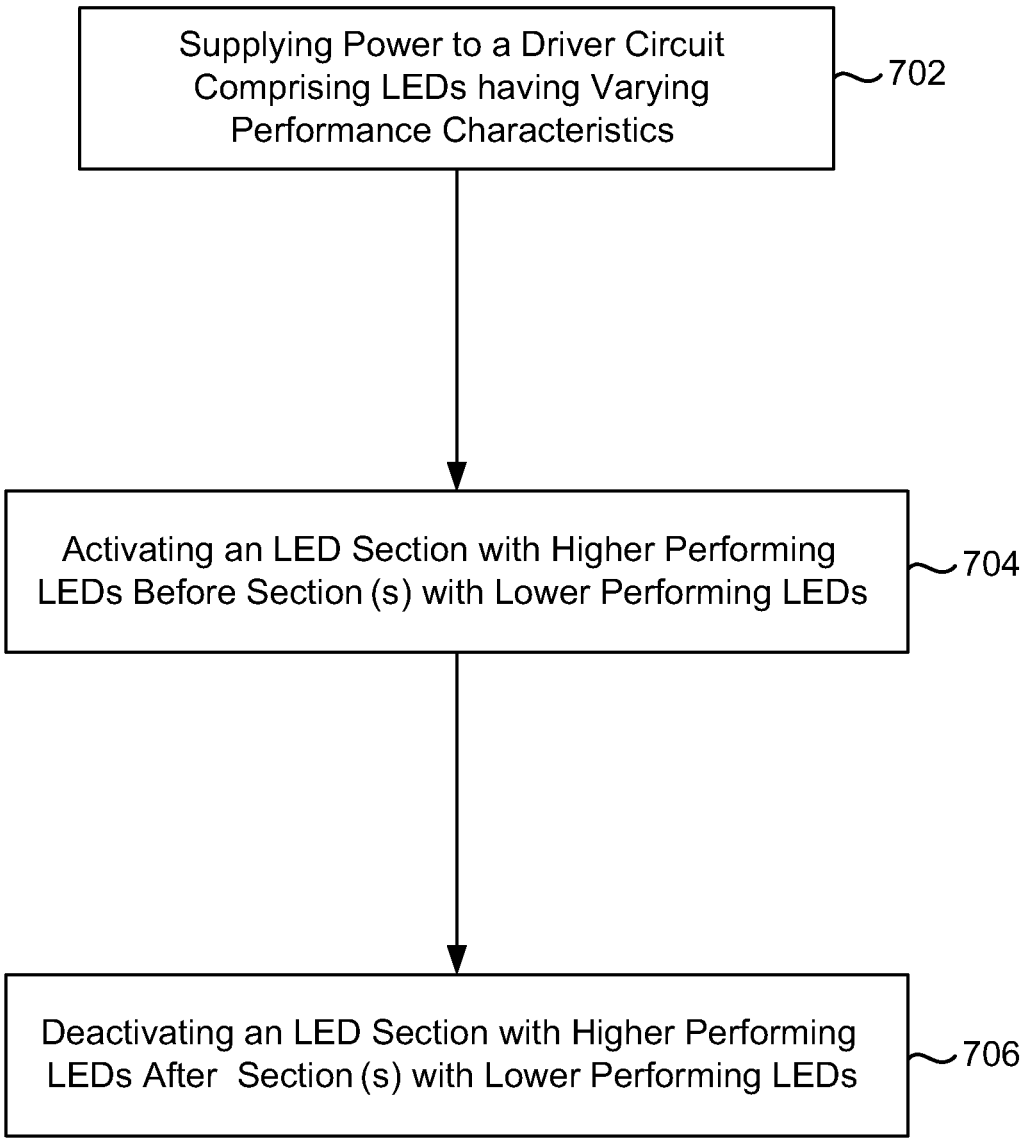
FIG. 7 is a flow chart showing various processes for powering a light producing device comprising a multiplicity of LED sections populated with LEDs of varying performance characteristics in accordance with various embodiments.

Turning now to FIG. 7, there is illustrated various processes for powering a light producing device comprising a multiplicity of LED sections populated with LEDs of varying performance characteristics in accordance with various embodiments. The method shown in FIG. 7 involves supplying 702 power to a driver circuit comprising LED sections populated with one or more LEDs having varying performance characteristics. The method also involves activating 704 an LED section with higher performing LEDs before a section or sections with lower performing LEDs. The method further involves deactivating 706 an LED section with higher performing LEDs after LED sections with lower performing LEDs.

Figure 8:
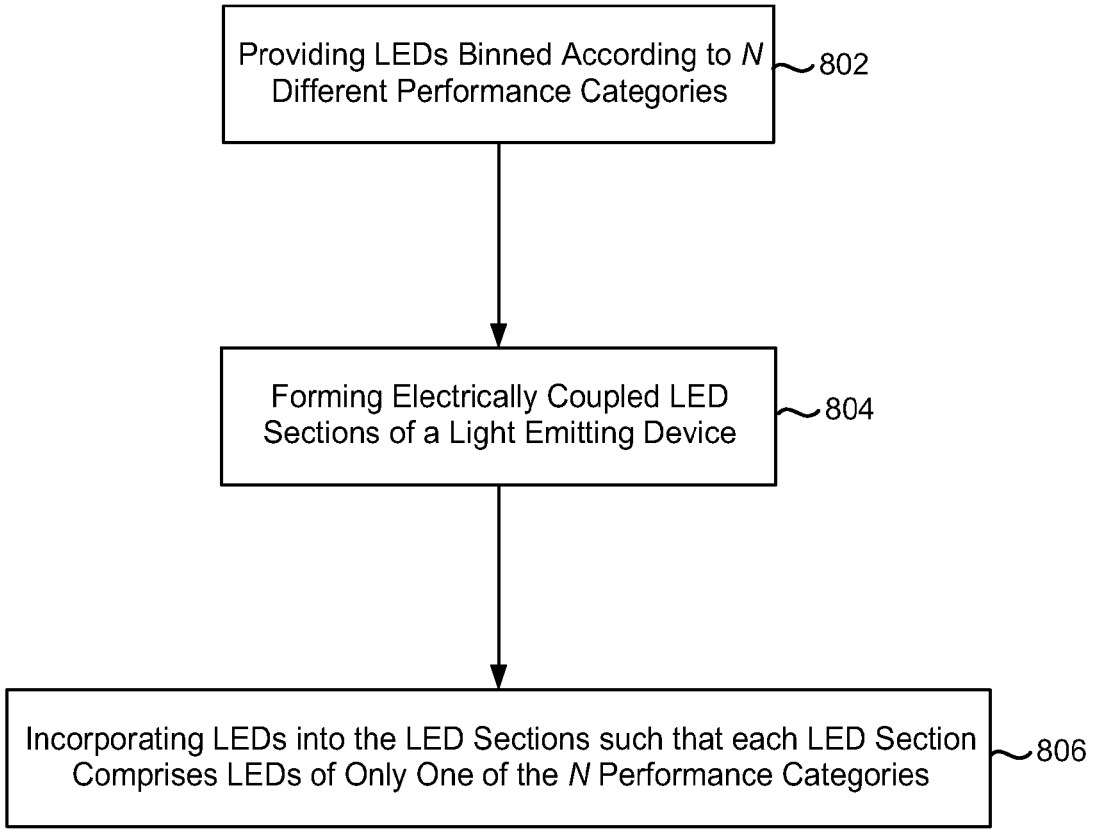
FIG. 8 illustrates various processes for manufacturing a light producing device comprising a multiplicity of LED sections populated with LEDs of varying performance characteristics in accordance with various embodiments.

FIG. 8 illustrates various processes for manufacturing a light producing device comprising a multiplicity of LED sections populated with LEDs of varying performance characteristics in accordance with various embodiments. The method shown in FIG. 8 involves providing 802 LEDs binned according to N different performance categories, where N is an integer greater than one. The method of FIG. 8 also involves forming 804 electrically coupled LED sections of a light producing device. The method shown in FIG. 8 further involves incorporating 806 one or more LEDs into each of the LED sections, such that each LED section comprises one or more LEDs of only one of the N performance categories.

Figure 9:
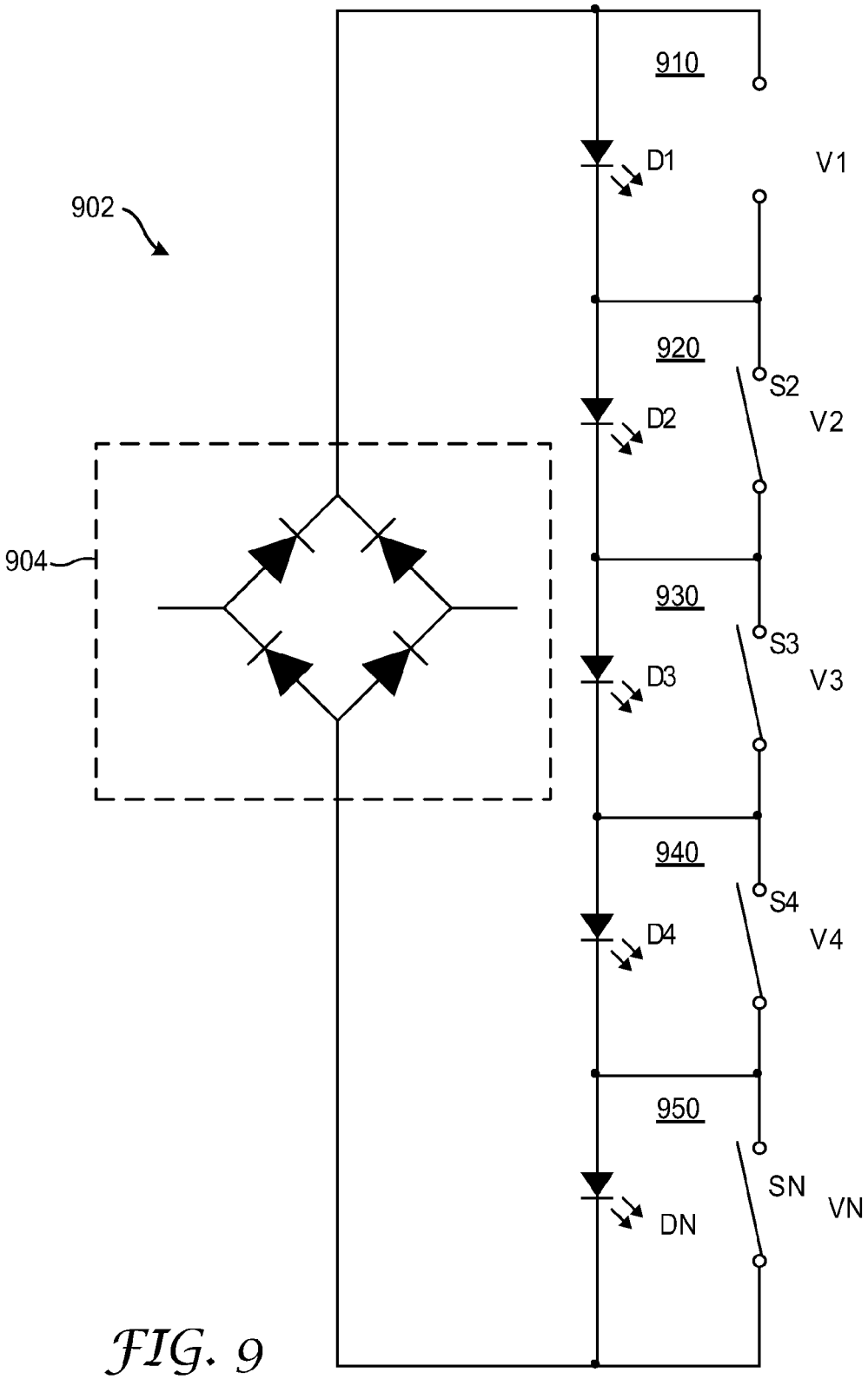
FIG. 9 is a schematic of a light producing device comprising a multiplicity of LED sections populated with LEDs of varying performance characteristics in accordance with embodiments of the disclosure.

FIG. 9 is a schematic of a light producing device comprising a multiplicity of LED sections populated with LEDs of varying performance characteristics in accordance with embodiments of the disclosure. The light producing device 902 shown in FIG. 9 can be implemented as an LED transistor ladder driver with current regulation, representative embodiments of which are disclosed in commonly owned, U.S. Patent Application Ser. No. 61/570,995 filed Dec. 15, 2011, which is incorporated herein by reference. The light producing device 902 includes a rectifier circuit 904 configured to couple to an AC power source (not shown) and a multiplicity of LED sections 910, 920, 930, 940, and 950 connected in series. It is understood that the light producing device shown in FIG. 9 can include any number of LED sections, and that the five LED's sections shown in FIG. 9 is for non-limiting illustrative purposes. The LED sections 910-950 include LEDs D1-DN and switches S2-SN. Each LED D1-DN typically represents a multiplicity of LEDs, such as an array of between 2 and N LEDs. In some embodiments, the schematic of FIG. 9 is implemented as a driver circuit, which can be embodied as an integrated circuit configured to perform the necessary conversion to drive the LEDs D1-DN. In various embodiments, the driver circuit of FIG. 9 is driven using a sinusoidal waveform, while in other embodiments the current is controlled section by section, resulting in a square or stepped waveform.

Figure 10:
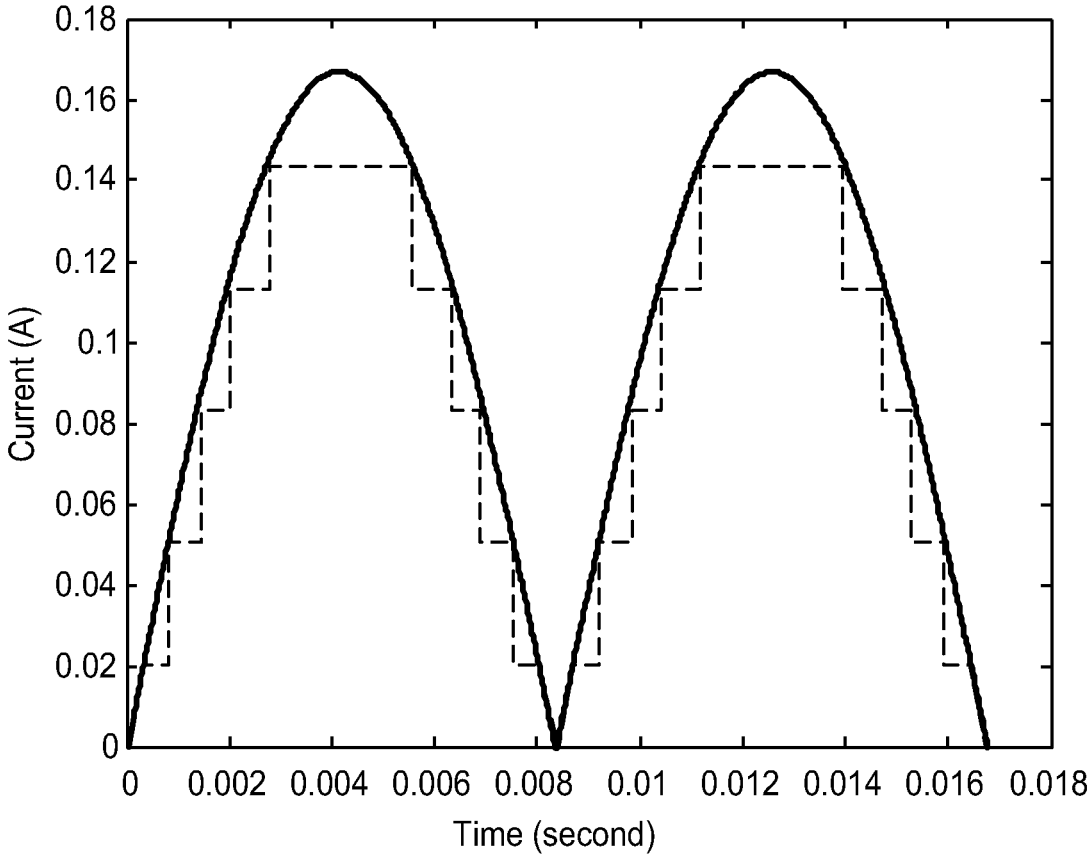
FIG. 10 is an illustration of a resulting current profile for the schematic of FIG. 9, which is shown both as an ideal sinusoidal waveform (solid line) and a sectionally controlled current waveform (dashed line) for illustrative purposes.

In accordance with one illustrative example, each LED D1-DN represents an array of 10 LEDs to obtain a forward voltage of approximately 30 V. In this illustrative example, the switches S2-SN are configured to open at the indicated voltages, V2-VN. LED section 910 does not incorporate a switch in order to avoid a case where all switches of the light producing device 902 would be conducting, thereby resulting in a short. V1, in the case of LED section 910, represents the forward voltage of the LEDs D1. In accordance with an illustrative example, switches S2-SN can be opened at the following indicated voltages: V2=60 V, V3=90 V, V4=120 V, and VN=150 V. An illustration of a resulting current profile for the schematic of FIG. 9 is shown in FIG. 10, which is shown both as an ideal sinusoidal waveform (solid line) and a sectionally controlled current waveform (dashed line) for illustrative purposes. In practice, the current profile will depart from the ideal sine wave form and will show current limiting steps in the profile, as is indicated by the dashed lines in FIG. 10. This will negatively affect the power factor, but with careful design a power factor of 0.95 or greater can be obtained.

Each of the switches or switch circuits S2-SN is normally closed or conducting. When the supply voltage increases above a predetermined threshold of a particular switch (e.g., threshold V2=60 V for S2 or V4=120 V for S4), the particular switch circuit is opened or non-conducting. The switch circuit of lower LED sections (i.e., those with switch voltage thresholds less than the supply voltage) are opened or non-conducting. As such, current flows through the LEDs in the LED sections from the first LED section to higher LED sections with opened switches and these LEDs become illuminated. The predetermined switch thresholds can be determined by the switch circuit design.

The switch circuits S2-SN may include one or more transistors. In some implementations, the switch circuits S2-SN may include a depletion mode transistor. The switch circuits S2-SN may include one or more resistive elements, for example, such as resistors. In some implementations, the switch circuits S2-SN may include a variable resistive element, which can be adjusted to fine tune the predetermined threshold relative to the output of the power source. The activation circuitry of the driver circuit can include a current regulating circuit configured to limit the LED current based upon the number of activated LED sections 910-950. The current regulating circuit may include a depletion mode transistor, a MOSFET, a high power MOSFET, or other components.

In the FIG. 9 implementation, selected LEDs D1-DN are powered for only a portion of the entire line cycle, with some LEDs being powered ON (i.e., activated) for a longer period of time than others. The timing of each LED D1-DN turning ON is known based on a given design, as well as the current flowing through each LED. This non uniformity of energy consumption through different LEDs D1-DN can be leveraged to improve the system performance (e.g., efficiency/efficacy, color temperature/CRI compliance) when using multiple "bins" of LEDs with different performance characteristics. According to various embodiments, multiple bins of LEDs of varying levels of performance are used in the making of the light producing device of FIG. 9 in order to reduce the cost of the device without sacrificing device performance.

The first LED section 910 in the driver circuit of FIG. 9 will turn ON first as well as turn OFF last. The first LED section 910 is populated using LEDs D1 obtained from the highest performance (efficiency/efficacy, color temperature/CRI compliance) bin, since the LEDs D1 of LED section 910 consume the most amount of energy. The LEDs DN of the last LED section 950 are last to turn ON, and the first to turn OFF. As such the LEDs DN of the last LED section 950 are obtained from the lowest performance LED bin as it consumes the least amount of energy. The LEDs D2-D4 of LED sections 920-940 can be obtained from bins with LEDs of moderate performance, between highest and lowest performance. By doing this, the system's performance, whether measured in terms of efficiency, efficacy, color temperature, or CRI, is shifted above the midpoint or average of the LED bins used. The net result by doing this is a substantial decrease in system cost with minimum detrimental impact to system performance.

Figure 11:
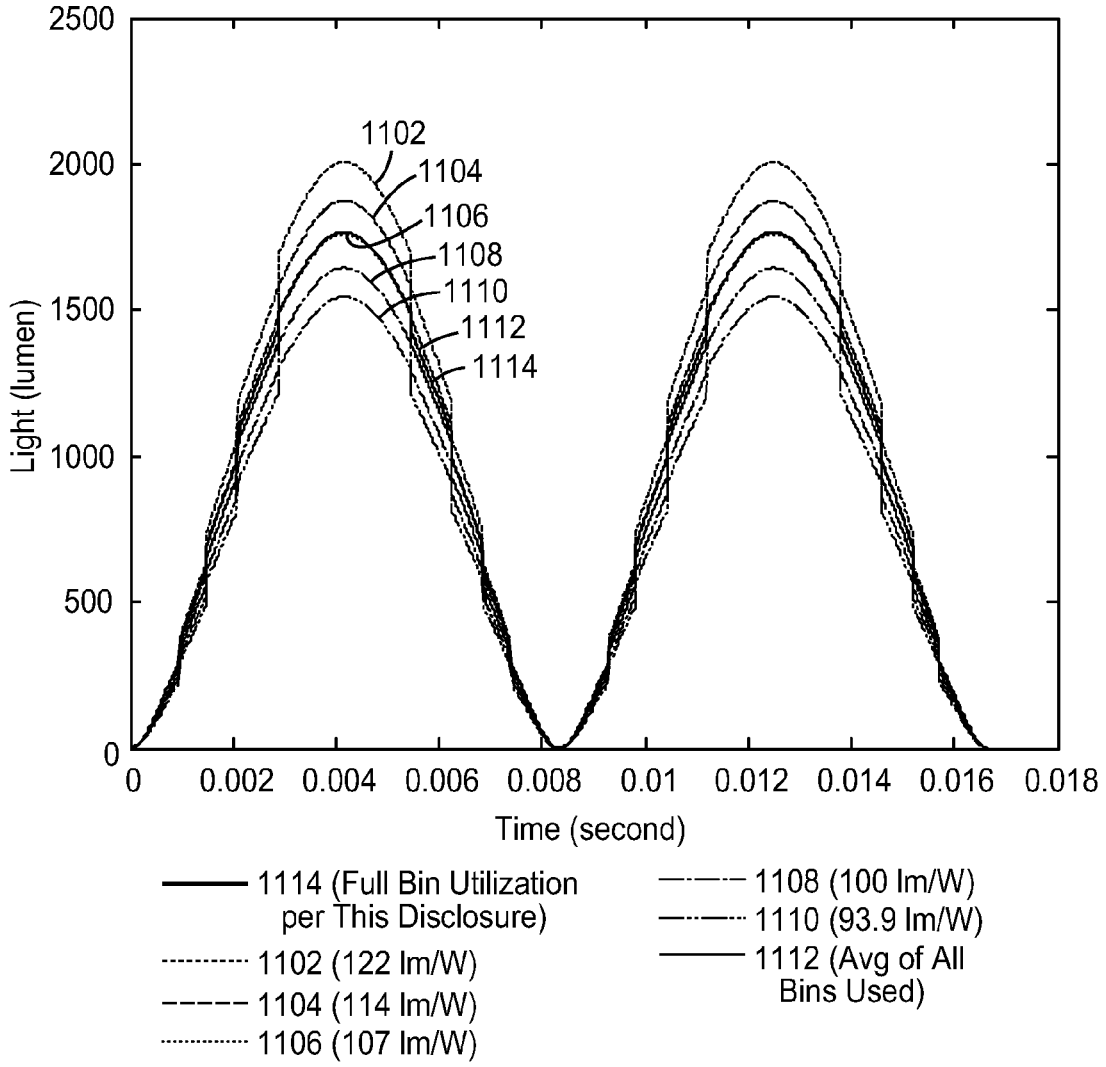
FIG. 11 is a graph showing light output versus time for the light producing device illustrated in FIG. 9.
Figure 12:
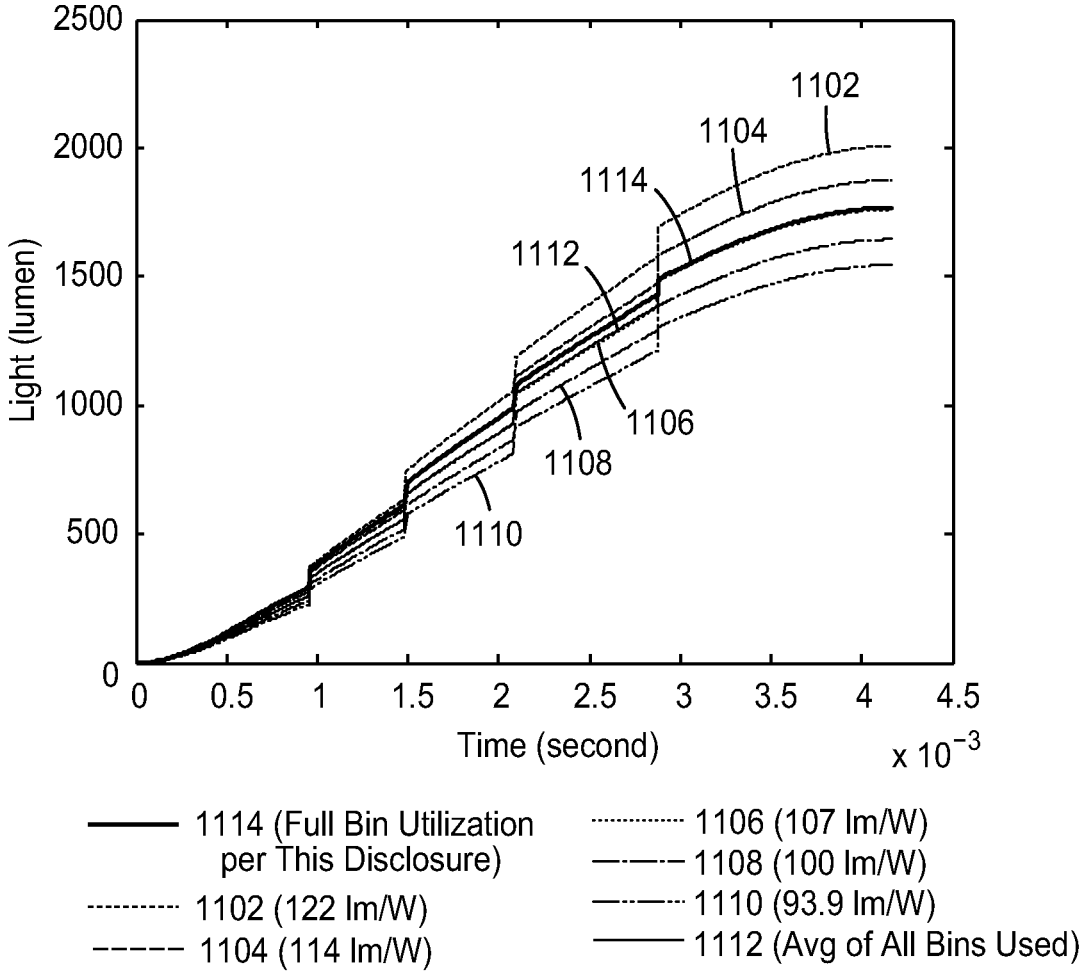
FIG. 12 is a light versus time graph showing quarter line cycle photometric power of the five LED sections of the light producing device shown in FIG. 9.

A computer simulation of the five LED section system shown in FIG. 9 resulted in the behavior shown in FIGS. 11 and 12. FIG. 11 is a graph showing light power (lumen) versus time (second) for the light producing device 902 illustrated in FIG. 9. FIG. 11 shows full line cycle photometric power of the five LED sections S1-SN of the light producing device 902. FIG. 12 is a light versus time graph showing quarter line cycle photometric power of the five LED sections S1-SN of the light producing device 902. In the computer simulation of the circuitry shown in FIG. 9, from which the light versus time graphs of FIGS. 11 and 12 were produced, each of the five LED sections S1-SN (where N=5 in this example) of the light producing device 902 was populated using 10 LEDs obtained from the following 5 bins representing a manufacturer's full distribution of LED bins:

S1: LEDs obtained from a 122 lm/W bin
S2: LEDs obtained from a 114 lm/W bin
S3: LEDs obtained from a 107 lm/W bin
S4: LEDs obtained from a 100 lm/W bin
S5: LEDs obtained from a 93.9 lm/W bin It is noted that the light producing device 902 can be made using fewer LED bins of a manufacturer's full distribution of LED bins, but at a cost penalty. It is further noted that one or more of the LED sections S1-SN of the light producing device 902 can be include LED's from more than one LED bin. For example, one or more of the LED sections S1-SN can be populated by a mix of LEDs from different bins. The ratio of high to low bin performance LEDs can vary from section to section. For example, an LED section that is powered ON for a longer duration relative to other LED sections can include a mix of LEDs having a higher ratio of high to low bin performance LEDs. An LED section that is powered ON for a shorter duration relative to other LED sections can include a mix of LEDs having a lower ratio of high to low bin performance LEDs.

When all LEDs D1-DN (where N=5 in this example) are turned ON with equal current flow, the system results in the average efficiency (line 1112 in FIGS. 11 and 12) of the LEDs D1-DN used as expected. However, when the line voltage is below the peak setting, the efficiency increases towards the higher efficiency LEDs. The bolded black line 1114 in FIGS. 11 and 12 shows the resulting efficiency. At any given point, the efficiency shown in FIGS. 11 and 12 is the average efficiency of the LEDs that are conducting current. The net result is an average system efficiency, and thus light output, slightly higher than the output averaged over the LEDs used in the system.

At an average LED power of 11.44 W, for example, the resulting average photometric power of the five bins is 942 lm. When driving these bins in a manner described herein, the average photometric power is increased to 966 lm. This increase translates to roughly a 2 lm/W or 2.5% improvement. This seemingly small improvement is significant in a system constrained by temperature, cost, power, and size. One could argue that the temperature of the 93.9 lm/W LEDs in FIGS. 11 and 12 would be lower and thus the efficiency would be higher, but in a system where all LEDs are mounted on the same heat sink in close proximity to another, this temperature difference would be negligible. The timing of the steps, as well as the size of the steps, can be optimized to better match the line voltage, thus improving power factor, as well as optimize the system efficiency. For example, having more steps at the lower voltage spectrum, will further improve the system efficiency as it leverages the use of high efficiency LEDs, as well as reduced conducting losses for the voltage gaps between LED sections. The end design will be influenced by the distribution of LEDs used.

Figure 13:
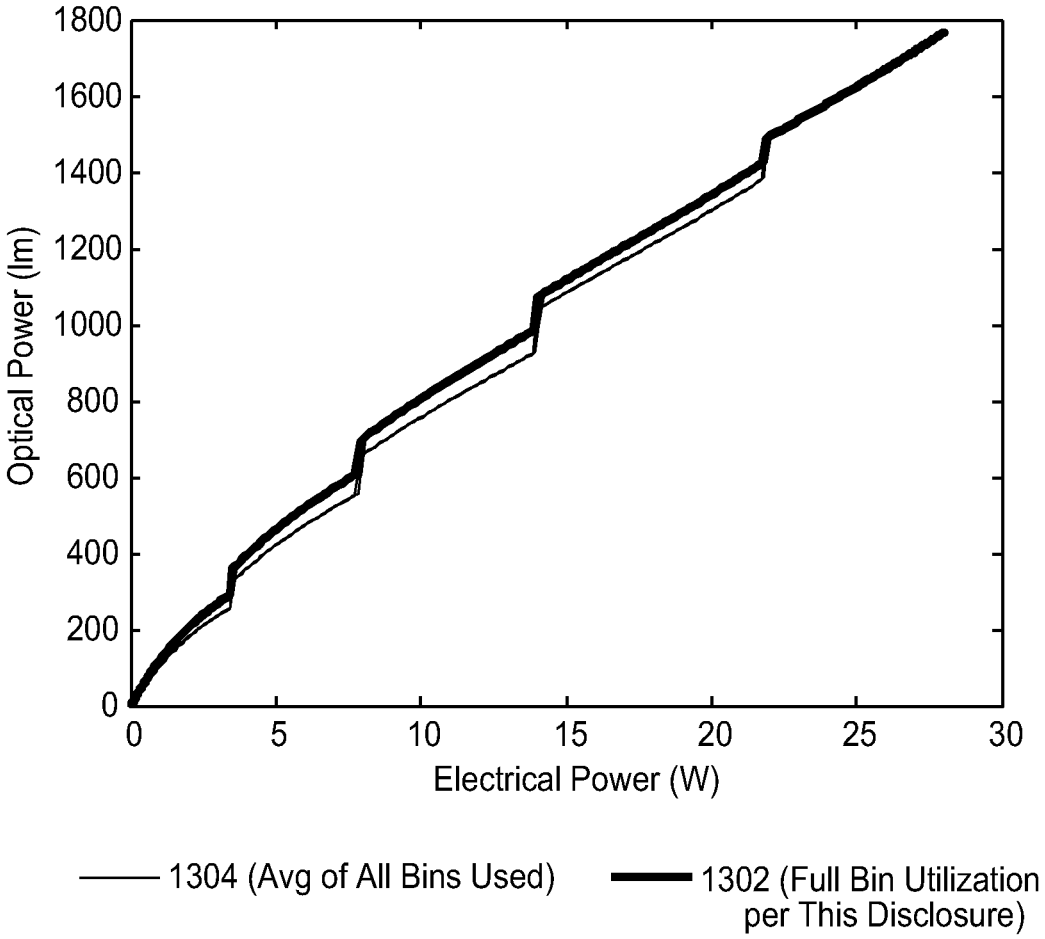
FIG. 13 is a graph showing lumen output versus electric power applied to the LEDs of the light producing device illustrated in FIG. 9.
Figure 14:
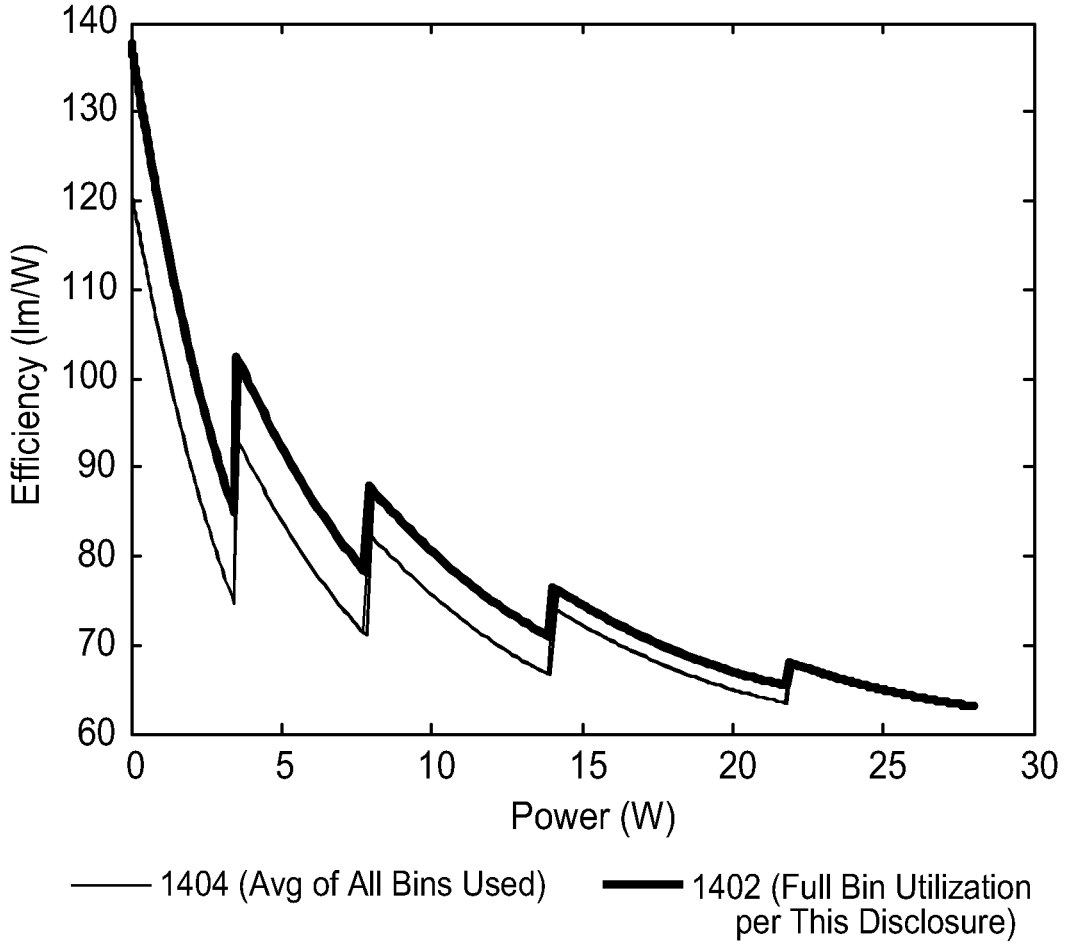
FIG. 14 is a graph of efficiency versus power applied to the LEDs of the light producing device illustrated in FIG. 9.

FIG. 13 is a graph showing lumen output versus electric power applied to the LEDs of the light producing device 902 illustrated in FIG. 9. The bolded black line 1302 shows lumen output versus electrical power for full LED bin utilization, while the thinner line 1304 shows lumen output versus electrical power of the bin average. This computer simulation used to generate the graph of FIG. 13 takes into account the effect of drive current at each LED D1-DN. Since LED efficiency drops with increased current, there is a slight bump in efficiency when additional LEDs are switched in. This, however, can be optimized for a given design. FIG. 14 is a graph of efficiency versus power applied to the LEDs of the light producing device 902 illustrated in FIG. 9. The graph of FIG. 14 shows that system efficiency drops with increasing number of LEDs and power. The bolded black line 1402 shows the increased efficiency by using the method described above (e.g., full LED bin utilization) for driving multiple bins of LEDs. The thinner line 1404 indicates the system efficiency if the average LED bin were to be used. It is noted that the graph of FIG. 14 can be optimized such that the steps are flat between LED segments.

Lifetime of the lower efficiency LEDs would be expected to be extended as the lower efficiency LEDs are not in the ON-state as long as the higher efficiency LEDs. Since LED lifetime is defined as a 20% reduction in light output, the net result is that as the system approaches its end of life (approximately 50,000 hours) the system will tend towards the standard efficiency that would have been obtained if the LED bins were placed at random. The bulb will of course still produce light. It is noted that the same method described hereinabove using LED binning based on efficiency can also be applied to binning using multiple color bins of LEDs and mixing to get the desired color output. For example, 2700K LEDs could be mixed with 3000K LEDs to reach a desired light output of closer 2800K rather than obtaining the midpoint of 2850K.

Embodiments of the disclosure are directed to a light producing device that incorporates LEDs across a manufacturer's full distribution of LED bins and dimmer circuitry. Various dimmer circuitry, such as phase cut dimmer or harmonic current dimmer circuitry, can be incorporated in a ladder network light producing device described previously hereinabove. A ladder network of LED sections, such as that shown in FIG. 9, can include a dimming capability by the addition of a dimmer circuit, which provides for activation of only a selected number of LED sections S1-SN of the ladder. This selected number of LED sections can include only the first section (S1), all sections (S1-SN) or a selection from the first section (S1) to a section $S_n$ where n<N. The dimmer circuit can be configured to control the number of the LED sections S1-SN activated in sequence. The intensity (dimming) can be controlled based upon how many LED sections S1-SN are active with the LEDs turned ON with a particular intensity selected by the dimmer circuit.

According to some embodiments, the sectioned ladder network can also enable color control through use of a dimmer circuit. The color output collectively by the LEDs D1-DN is determined by the dimmer controlling which of the LED sections S1-SN are active, the selected sequence of light sections S1-SN, and the arrangement of LEDs in the light sections S1-SN from the first light section S1 to the last light section SN. As the light sections S1-SN turn ON in sequence, the arrangement of the LEDs D1-DN determines the output color with colors 1, 2, . . . n correlated to the color of the LEDs D1-DN in light sections S1-SN. The output color is also based upon color mixing among active LEDs D1-DN in the selected sequence of light sections S1-SN in the sectioned ladder network.

In accordance with other embodiments, a light producing device of the disclosure can be implemented to mimic the desirable color temperature dimming effects obtained with incandescent lights. A representative desirable color temperature dimming effect can be realized by placing warmer color temperature LEDs (e.g., 2400 K) in either the lower or higher LED sections, and having cooler LEDs (e.g., 4000K) in the other LED sections. Dimming can be achieved by reducing the current supplied to LED section(s) with the cooler LEDs before reducing the current supplied to LED section(s) with the warm LEDs. This type of dimming can have great applicability for designs for 3-way sockets and wireless communication. According to some embodiments, a driver circuit includes a multiplicity of LED sections populated with LEDs of varying color temperature as described above, and further incorporates a dimmer configured to adjust current among different LED sections to produce a warm dimming experience, similar to dimming a traditional incandescent bulb for example. For example, dimmer circuitry can be integral to the driver circuit and configured to adjust current among different LED sections to produce a desirable dimming experience with sufficient warm color temperature spectral content.

Figure 15:
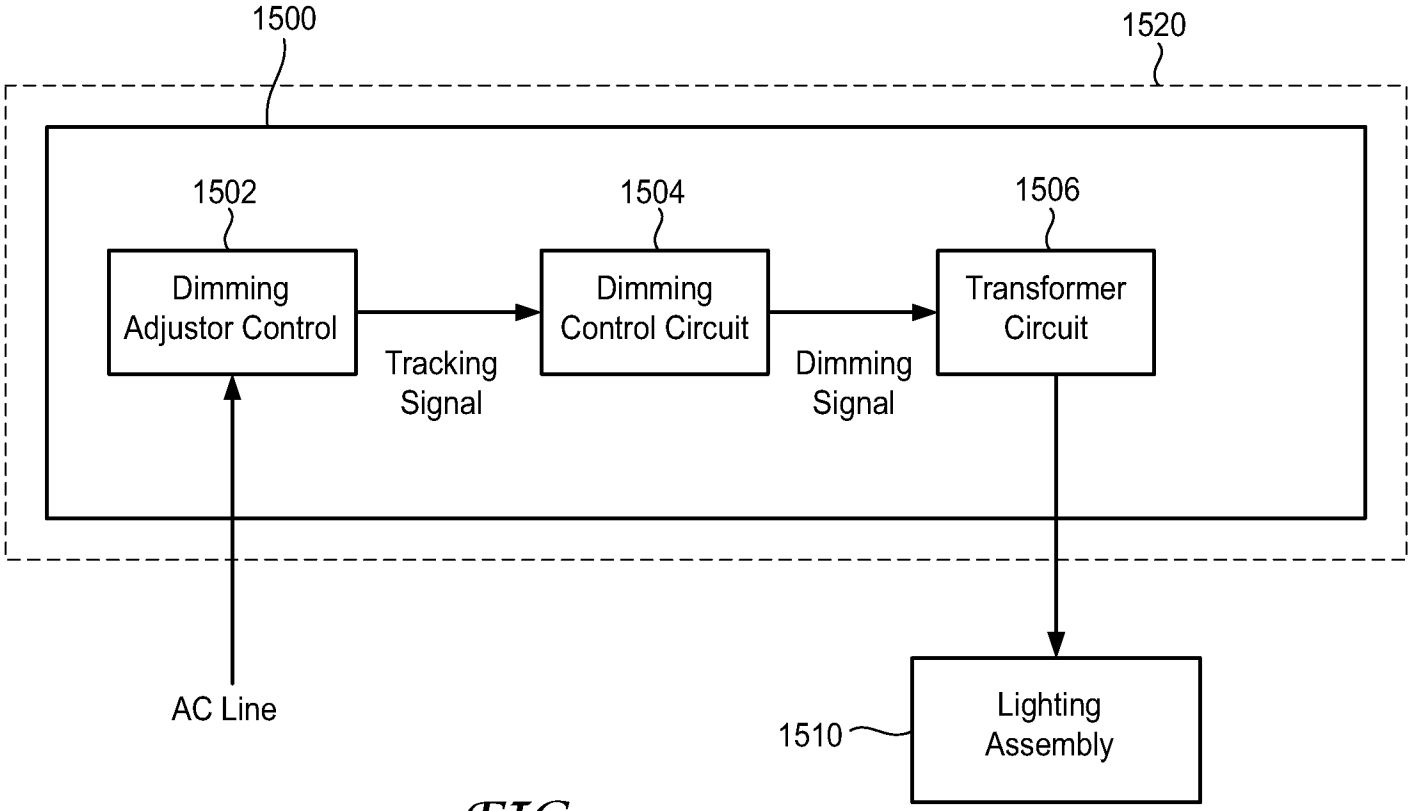
FIG. 15 is a block diagram of a representative dimming circuit configured to allow a user to adjust dimming levels of a light producing device that incorporates LEDs across a manufacturer's full distribution of LED bins according to embodiments of the disclosure.

With reference to FIG. 15, there is shown a block diagram of a representative dimming circuit 1500 configured to allow a user to adjust dimming levels of a light producing device that incorporates LEDs across a manufacturer's full distribution of LED bins according to embodiments of the disclosure. The dimming circuit 1500 can be configured to track the line voltage of the AC line and provide line isolation such that harmonic dimming can be achieved.

According to various embodiments, the dimming circuit 1500 includes a dimming adjust control 1502 coupled to a dimming control circuit 1504 and a transformer circuit 1506. The dimming adjustor control 1502 is configured to generate a tracking signal indicative of the dimming level set by the user operating the dimming adjustor control 1502. In addition, the tracking signal generally tracks a line voltage of the AC line. The dimming control circuit 1504 is coupled to the dimming adjustor control 1502 and configured to receive the tracking signal. The dimming control circuit 1504 is also configured to generate a dimming signal. The transformer circuit 1506 is coupled to the dimming control circuit 1504 and configured to receive the dimming signal and provide power to a lighting assembly 1510 in response to the dimming signal. In some embodiments, the transformer circuit 1506 includes a flyback transformer.

The dimming circuit 1500, in some configurations, can optionally have a housing or support 1520 that is different from that of the lighting assembly 1510. The dimming adjustor circuit 1502, the dimming control circuit 1504, and/or the transformer circuit 1506 can be disposed in the housing 1520. In some implementations, at least part of the dimming circuit 1500 can be accessible through the housing 1520, for example, a knob, a switch or a button on the outside surface of the housing 1520. In some configurations, the dimming circuit 1500 has a power factor greater than 0.8. In other configurations, the dimming circuit 1500 has a power factor greater than 0.9.

Figure 16:
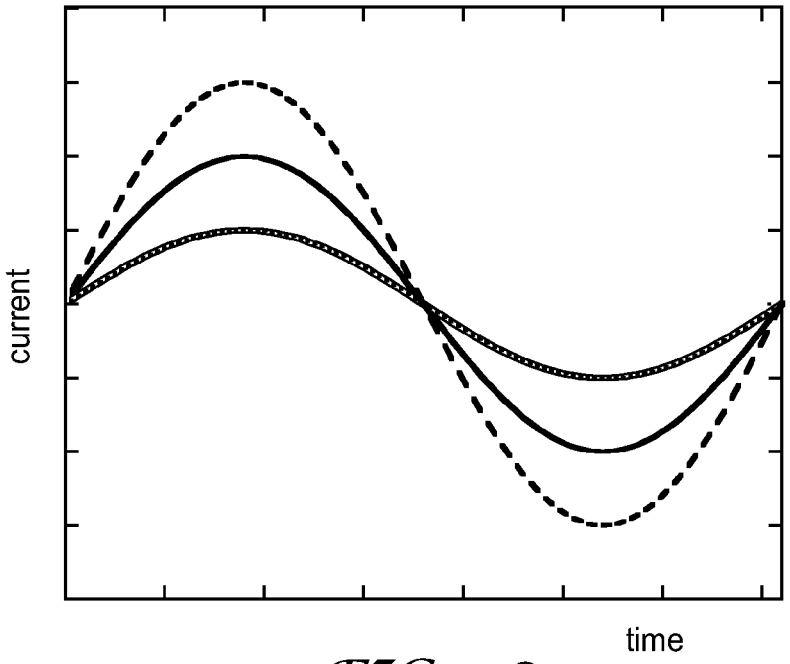
FIG. 16 is a graph of current versus time for three different harmonic dimming levels selectable by a user via the dimming circuit of FIG. 15.

FIG. 16 is a graph of current versus time for a representative harmonic dimming circuit such as that shown in FIG. 15. FIG. 16 shows harmonic current dimming for three different dimming levels, each selectable by a user. As can be seen in FIG. 16, dimming is established by conducting the entire current cycle but at different amplitude level. As a result, gradual dimming will first extinguish the upper level LED sections (e.g., S1 et seq. in FIG. 9). If the lower LED sections (e.g., S4 et seq. in FIG. 9) contain LEDs of a lower color temperature compared to the upper sections, then dimming will result in a gradual color temperature shift towards warmer or lower color temperature light. This effect is also observed in incandescent bulbs and may be a desired feature with sectioned LED strings in combination with harmonic dimmers. This form of dimming also renders very good power factor along with the color control.

Figure 17:
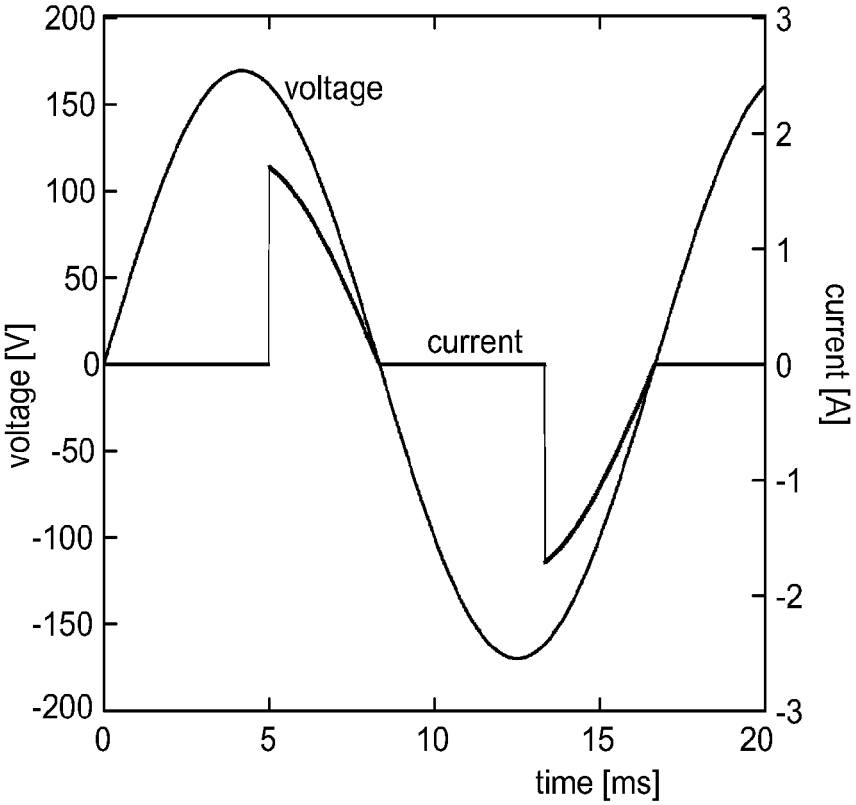
FIG. 17 shows a graph of line voltage and current versus time for a phase cut dimming circuit, such as one that uses TRIAC or transistor-based dimmer electronics in accordance with various embodiments.

FIG. 17 shows a graph of line voltage and current versus time for a phase cut dimming circuit, such as one that uses TRIAC or transistor-based dimmer electronics. It can be seen in FIG. 17 that only a portion of a sine wave current is provided to the lighting assembly when using phase cut dimming electronics. Dimming is established by allowing the firing angle to go from zero degrees (ON) to 180 degrees (OFF). Dimming over the first 90 degrees of the sine wave will still illuminate all LED sections (e.g., S1-SN in FIG. 9) of the entire LED ladder network, but the LEDs D1-DN are illuminated less of the time. Further dimming in the range between 90 and 180 degrees, as can be seen in FIG. 17, will completely extinguish the upper LED sections (e.g., S1 et seq. in FIG. 9) of the LED ladder network until all LED sections S1-SN are extinguished near a 180 degree firing angle. In some configurations, so-called reverse phase dimmers use transistors instead of TRIACs and the conducted line current is a mirror image of the profile shown in FIG. 17. However, the essential illumination result is not different from the TRIAC case described above.

Various embodiments are directed to controlling LED color temperature using dimming circuitry within a light producing device that incorporates LEDs across a manufacturer's full distribution of LED bins. If, for example, 2400K LEDs are used in a first LED section of a 3-section LED ladder network, 2700K LEDs are using in the second LED section, and 4000K LEDs are used in the third LED section, color temperature can be adjusted by changing current in the three LED sections. If a warmer color temperature is desired, for example, the 4000K LED section current can be reduced. This is readily achievable in a system where the electronics are controlled, such as in a 3-way dimming bulb or in a wireless controlled bulb. An illustrative example showing color control via changing LED section current setting is provided in FIG. 18.

Figure 18:
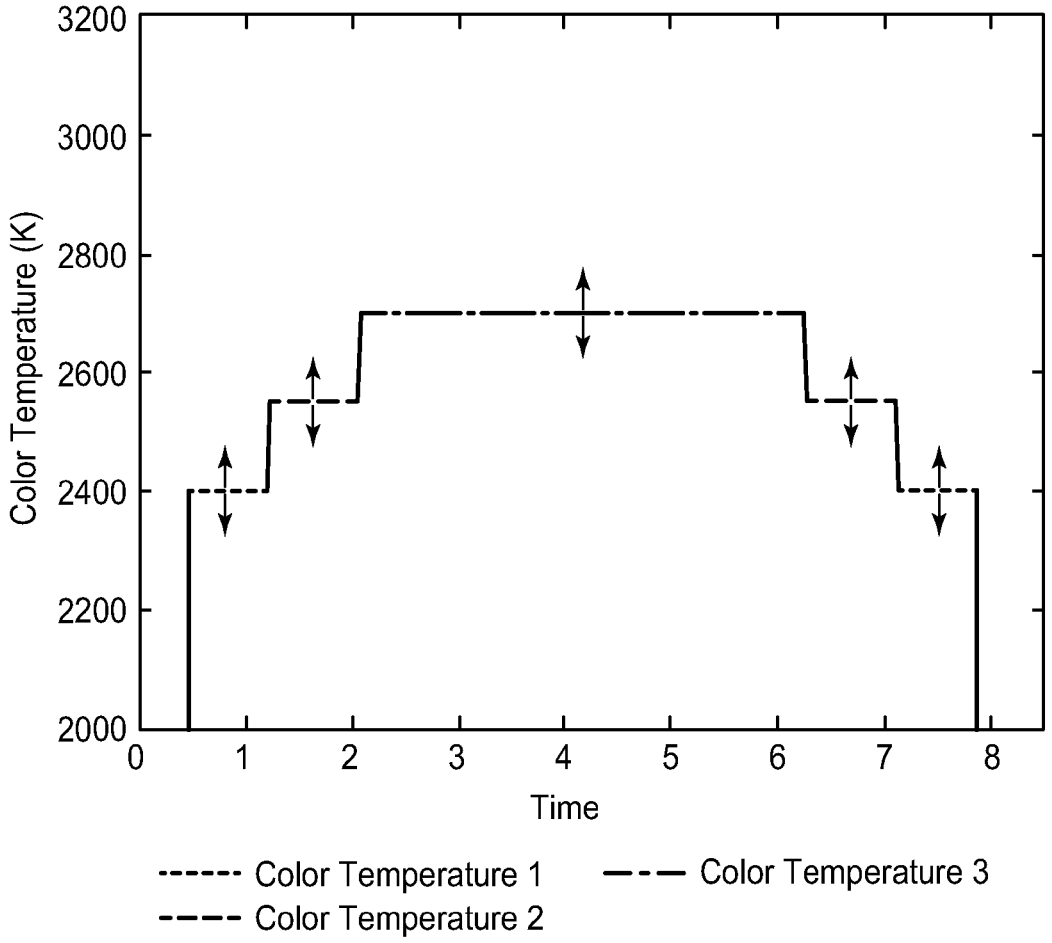
FIG. 18 is an illustrative example showing color control via changing LED section current setting in accordance with various embodiments.

The resulting visible color temperature in the illustrative graph of FIG. 18 is the time average over one line cycle. Controlling the overall color temperature in a sectioned ladder network of LEDs, such as for providing warm dimming, can be achieved by controlling the current to each of the LED sections using external resistors. It is understood that using this type of dimming will negatively affect the system's power factor. Alternatively, this same approach can be used as an end of line test/calibration during the manufacturing process. In this manner, a wider array of color bins can be used to hit a set color point by adjusting the current settings for each LED section at the end of the manufacturing line. Using some silicon processes, for example, this can be adjusted very quickly, but may require some specialized ASIC development.

Greater acceptance of LED color bins or flux (light output) bins can be realized by characterizing the bulb or other lighting device at the end of production, such as by performing an instant-on measurement. Light (color or brightness) can then be adjusted by programming the controlling IC of the bulb or lighting device. This programming can be performed either in hardware (e.g., via an FPGA or semiconductor device that is capable of changing resistance/current for LED segments) or software. According to some embodiments, a light producing device incorporating a sectioned ladder network of LEDs can be subjected to testing that measures the light performance of the device. Current supplied to the LED sections can be adjusted to meet performance targets.

Various modifications and alterations of this invention will be apparent to those skilled in the art without departing from the scope of this invention, and it should be understood that this invention is not limited to the illustrative embodiments set forth herein. The reader should assume that features of one disclosed embodiment can also be applied to all other disclosed embodiments unless otherwise indicated. It should also be understood that all U.S. patents, patent application publications, and other patent and non-patent documents referred to herein are incorporated by reference, to the extent they do not contradict the foregoing disclosure.

This document discloses numerous embodiments, including but not limited to the following:

Item 1. A driver circuit configured for connection to a power source, comprising:

a plurality of light emitting diodes (LEDs) having efficiencies that vary according to different efficiency categories ranging between higher efficiency and lower efficiency;

a plurality of LED sections each populated with at least one LED of a different one of the different efficiency categories; and circuitry coupled to the LED sections and configured to activate and deactivate the LED sections based on LED efficiency.

Item 2. The circuit of item 1, wherein the circuitry is configured to activate an LED section with higher efficiency before an LED section with lower efficiency.

Item 3. The circuit of item 2, wherein the circuitry is configured to deactivate the LED section with higher efficiency after the LED section with lower efficiency.

Item 4. The circuit of item 1, wherein each of the LED sections comprises a plurality of LEDs.

Item 5. The circuit of item 1, wherein the LED sections are arranged to establish a series connected ladder network circuit.

Item 6. The circuit of item 1, wherein the circuitry comprises a plurality of switches, such that one switch is coupled in parallel with the at least one LED for each LED section other than for a first LED section, and each of the switches is configured to open at a predetermined voltage differing from that for other switches.

Item 7. The circuit of item 6, wherein each of the plurality of switches comprises a transistor.

Item 8. The circuit of item 1, further comprising a dimmer coupled between the power source and the LED sections.

Item 9. The circuit of item 8, wherein the dimmer comprises harmonic dimming electronics.

Item 10. The circuit of item 8, wherein the dimmer comprises phase cutting electronics.

Item 11. The circuit of item 8, wherein the dimmer is integral to the driver circuit and configured to adjust current among different LED sections to produce a desirable dimming experience with sufficient warm color temperature spectral content.

Item 12. The circuit of item 1, wherein the circuit is configured to drive the LEDs with a square or stepped waveform.

Item 13. The circuit of item 1, wherein the circuit is configured to drive the LEDs with a power factor of at least about 0.95.

Item 14. The circuit of item 1, wherein the circuit is configured to facilitate adjustment of current supplied to the LED sections during manufacturing to meet performance targets.

Item 15. A driver circuit configured for connection to a power source, comprising:

a plurality of light emitting diodes (LEDs) having efficiencies that vary according to different efficiency categories ranging between higher efficiency and lower efficiency;

a plurality of LED sections each populated with at least one LED of a different one of the different efficiency categories; and circuitry coupled to the LED sections and configured to power the LED sections at different duty cycles based on LED efficiency.

Item 16. The circuit of item 15, further comprising a dimmer coupled between the power source and the LED sections.

Item 17. A driver circuit configured for connection to a power source, comprising:

a plurality of light emitting diodes (LEDs) having at least one performance characteristic that varies according to different performance categories ranging between higher performance and lower performance;

a plurality of LED sections each populated with at least one LED of a different one of the different performance categories; and circuitry coupled to the LED sections and configured to activate and deactivate the LED sections based on LED performance.

Item 18. The circuit of item 17, wherein the at least one LED performance characteristic comprises color, color temperature or color rendering index.

Item 19. The circuit of item 17, wherein:

the plurality of different performance categories comprise between 2 and 12 different performance categories; and the plurality of LED sections correspond in number to the number of different performance categories.

Item 20. The circuit of item 17, wherein the circuitry is configured to power the LED sections at different duty cycles based on LED performance.

Item 21. A method, comprising:

supplying power to a driver circuit comprising a plurality of light emitting diodes (LEDs) that vary in terms of at least one performance characteristic falling into one of a plurality of different performance categories, the driver circuit further comprising a plurality of electrically coupled LED sections each comprising one or more LEDs of only one of the different performance categories;

sequentially activating the LED sections according to a sequence progressing from LED sections with higher performance LEDs to those with lower performance LEDs; and sequentially deactivating the LED sections according to a sequence progressing from LED sections with lower performance LEDs to those with higher performance LEDs.

Item 22. The method of item 21, wherein sequentially activating and deactivating the LED sections comprises:

progressively activating an LED section with higher performance LEDs before one with lower performance LEDs; and progressively deactivating an LED section with higher performance LEDs after one with lower performance LEDs.

Item 23. A method, comprising:

providing a plurality of light emitting diodes (LEDs) that vary in terms of at least one performance characteristic falling into one of a plurality of different performance categories;

forming a plurality of electrically coupled LED sections of a light producing device, each of the LED sections configured to controllably power one or more of the LEDs; and incorporating the one or more LEDs associated with the different performance categories into respective LED sections of the light producing device, such that each LED section comprises one or more LEDs of only one of the different performance categories.

Item 24. The method of item 21, further comprising:

characterizing light performance of the light producing device during manufacturing; and adjusting current supplied to the LED sections to meet performance targets.

What is claimed is:

1. A driver circuit configured for connection to a power source, comprising:

a plurality of light emitting diodes (LEDs) having efficiencies that vary according to different efficiency categories ranging between higher efficiency and lower efficiency;

a plurality of LED sections each populated with at least one LED of a different one of the different efficiency categories; and circuitry coupled to the LED sections and configured to activate and deactivate the LED sections based on LED efficiency.

2. The circuit of claim 1, wherein the circuitry is configured to activate an LED section with higher efficiency before an LED section with lower efficiency.

3. The circuit of claim 2, wherein the circuitry is configured to deactivate the LED section with higher efficiency after the LED section with lower efficiency.

4. The circuit of claim 1, wherein each of the LED sections comprises a plurality of LEDs.

5. The circuit of claim 1, wherein the LED sections are arranged to establish a series connected ladder network circuit.

6. The circuit of claim 1, wherein the circuitry comprises a plurality of switches, such that one switch is coupled in parallel with the at least one LED for each LED section other than for a first LED section, and each of the switches is configured to open at a predetermined voltage differing from that for other switches.

7. The circuit of claim 6, wherein each of the plurality of switches comprises a transistor.

8. The circuit of claim 1, further comprising a dimmer coupled between the power source and the LED sections.

9. The circuit of claim 8, wherein the dimmer comprises harmonic dimming electronics.

10. The circuit of claim 8, wherein the dimmer comprises phase cutting electronics.

11. The circuit of claim 8, wherein the dimmer is integral to the driver circuit and configured to adjust current among different LED sections to produce a desirable dimming experience with warm color temperature spectral content.

12. The circuit of claim 1, wherein the circuit is configured to drive the LEDs with a square or stepped waveform.

13. The circuit of claim 1, wherein the circuit is configured to drive the LEDs with a power factor of at least about 0.95.

14. The circuit of claim 1, wherein the circuit is configured to facilitate adjustment of current supplied to the LED sections during manufacturing to meet performance targets.

15. A driver circuit configured for connection to a power source, comprising:

a plurality of light emitting diodes (LEDs) having efficiencies that vary according to different efficiency categories ranging between higher efficiency and lower efficiency;

a plurality of LED sections each populated with at least one LED of a different one of the different efficiency categories; and circuitry coupled to the LED sections and configured to power the LED sections at different duty cycles based on LED efficiency.

16. The circuit of claim 15, further comprising a dimmer coupled between the power source and the LED sections.

17. A driver circuit configured for connection to a power source, comprising:

a plurality of light emitting diodes (LEDs) having at least one performance characteristic that varies according to different performance categories ranging between higher performance and lower performance;

a plurality of LED sections each populated with at least one LED of a different one of the different performance categories; and circuitry coupled to the LED sections and configured to activate and deactivate the LED sections based on LED performance.

18. The circuit of claim 17, wherein the at least one LED performance characteristic comprises color, color temperature or color rendering index.

19. The circuit of claim 17, wherein:

the plurality of different performance categories comprise between 2 and 12 different performance categories; and the plurality of LED sections correspond in number to the number of different performance categories.

20. The circuit of claim 17, wherein the circuitry is configured to power the LED sections at different duty cycles based on LED performance.

21. A method, comprising:

supplying power to a driver circuit comprising a plurality of light emitting diodes (LEDs) that vary in terms of at least one performance characteristic falling into one of a plurality of different performance categories, the driver circuit further comprising a plurality of electrically coupled LED sections each comprising one or more LEDs of only one of the different performance categories;

sequentially activating the LED sections according to a sequence progressing from LED sections with higher performance LEDs to those with lower performance LEDs; and sequentially deactivating the LED sections according to a sequence progressing from LED sections with lower performance LEDs to those with higher performance LEDs.

22. The method of claim 21, wherein sequentially activating and deactivating the LED sections comprises:

progressively activating an LED section with higher performance LEDs before one with lower performance LEDs; and progressively deactivating an LED section with higher performance LEDs after one with lower performance LEDs.

23. A method, comprising:

providing a plurality of light emitting diodes (LEDs) that vary in terms of at least one performance characteristic falling into one of a plurality of different performance categories ranging between higher performance and lower performance;

forming a plurality of electrically coupled LED sections of a light producing device, each of the LED sections configured to controllably power one or more of the LEDs; and incorporating the one or more LEDs associated with the different performance categories into respective LED sections of the light producing device, such that each LED section comprises one or more LEDs of only one of the different performance categories.

24. The method of claim 21, further comprising:

characterizing light performance of the light producing device during manufacturing; and adjusting current supplied to the LED sections to meet performance targets.

* * * * *